US012516395B2

(12) United States Patent
Lorenzini

(10) Patent No.: US 12,516,395 B2
(45) Date of Patent: Jan. 6, 2026

(54) HEAT TREATED COLD ROLLED STEEL SHEET AND A METHOD OF MANUFACTURING THEREOF

(71) Applicant: ArcelorMittal, Luxembourg (LU)

(72) Inventor: Pascal Lorenzini, Woippy (FR)

(73) Assignee: ArcelorMittal, Luxembourg (LU)

( * ) Notice: Subject to any disclaimer, the term of this patent is extended or adjusted under 35 U.S.C. 154(b) by 449 days.

(21) Appl. No.: 17/783,114

(22) PCT Filed: Dec. 10, 2020

(86) PCT No.: PCT/IB2020/061725
§ 371 (c)(1),
(2) Date: Jun. 7, 2022

(87) PCT Pub. No.: WO2021/116956
PCT Pub. Date: Jun. 17, 2021

(65) Prior Publication Data

US 2022/0340992 A1 Oct. 27, 2022

(30) Foreign Application Priority Data

Dec. 13, 2019 (WO) ..... PCT/IB2019/060743

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/26*** | (2006.01) |
| ***C22C 38/38*** | (2006.01) |

(52) U.S. Cl.
CPC ..... *C21D 9/46* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0236* (2013.01); *C22C 38/001* (2013.01); *C22C 38/002* (2013.01); *C22C 38/02* (2013.01); *C22C 38/06* (2013.01); *C22C 38/26* (2013.01); *C22C 38/38* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 9/46; C21D 6/002; C21D 6/005; C21D 6/008; C21D 8/0205; C21D 8/0226; C21D 8/0236; C21D 2211/001; C21D 2211/002; C21D 2211/005; C21D 2211/008; C21D 8/0278; C21D 8/0263; C21D 8/0273; C21D 8/0247; C22C 38/001; C22C 38/002; C22C 38/02; C22C 38/06; C22C 38/26; C22C 38/38; C22C 38/24; C22C 38/28; C22C 38/22; C22C 38/32; C22C 38/58; C22C 38/60; C23C 2/40; B21C 47/02
See application file for complete search history.

(56) References Cited

U.S. PATENT DOCUMENTS

| | | | |
|---|---|---|---|
| 2012/0211128 | A1 | 8/2012 | Corquillet et al. |
| 2014/0000765 | A1 | 1/2014 | Nozaki et al. |
| 2014/0255724 | A1 | 9/2014 | Yamanaka et al. |
| 2014/0255725 | A1 | 9/2014 | Yamanaka et al. |
| 2016/0312326 | A1 | 10/2016 | Drillet et al. |
| 2018/0171459 | A1 | 6/2018 | Drillet et al. |
| 2019/0106765 | A1 | 4/2019 | Moulin et al. |
| 2020/0270713 | A1 | 8/2020 | Gospodinova et al. |

FOREIGN PATENT DOCUMENTS

| | | | | |
|---|---|---|---|---|
| CN | 101348885 | A | 1/2009 | |
| CN | 101363099 | A | 2/2009 | |
| CN | 102021483 | A | 4/2011 | |
| CN | 105874086 | A | 8/2016 | |
| EP | 2971209 | A1 | 1/2016 | |
| JP | 2009030081 | A | 2/2009 | |
| JP | 2009149937 | A * | 7/2009 | |
| JP | 2019505693 | A | 2/2019 | |
| KR | 20130123460 | A | 11/2013 | |
| WO | WO2013047810 | A1 | 4/2013 | |
| WO | WO2013047812 | A1 | 4/2013 | |
| WO | WO-2017125809 | A1 * | 7/2017 | ..... B32B 15/013 |

OTHER PUBLICATIONS

JP-2009149937-A english (Year: 2009).*
ISR of PCT/IB2020/061725 dated Feb. 2, 2021.
Written opinion of ISA of PCT/IB2020/061725.

* cited by examiner

*Primary Examiner* — Ricardo D Morales
(74) *Attorney, Agent, or Firm* — Davidson Kappel LLC

(57) ABSTRACT

A heat treated cold rolled steel sheet having a composition comprising of the following elements, 0.1%≤Carbon≤0.25%, 2.15%≤Manganese≤3.0%, 1%≤Silicon≤0.8%, 0.1%≤Aluminum≤0.9%, 0.05%≤Chromium≤0.5%, 0%≤Phosphorus≤0.09%, 0%≤Sulfur≤0.09%, 0%≤Nitrogen≤0.09%, 2.4%≤C+Mn≤3%, 0%≤Niobium≤0.1%, 0%≤Titanium≤0.1%, 0%≤Vanadium≤0.1%, 0%≤Molybdenum≤1%, 0%≤Nickel≤1%, 0%≤Calcium≤0.005%, 0%≤Boron≤0.01%, 0%≤Cerium≤0.1%, 0%≤Magnesium≤0.05%, 0%≤ Zirconium≤0.05% the remainder being composed of iron and unavoidable impurities, the microstructure of said steel sheet including, 20% to 70% Martensite, 5 to 60% of Inter-critical Ferrite, 5 to 30% of Transformed Ferrite, 8% to 20% of Residual Austenite and 1 to 20% Bainite, wherein the cumulated amount of Inter-critical and Transformed Ferrite is between 15% and 65%.

20 Claims, No Drawings

HEAT TREATED COLD ROLLED STEEL SHEET AND A METHOD OF MANUFACTURING THEREOF

The present invention relates to cold rolled steel sheet with high strength and high formability having tensile strength of 950 MPa or more and a total elongation of 14.0% or more which is suitable for use as a steel sheet for vehicles.

BACKGROUND

Automotive parts are required to satisfy two inconsistent necessities, namely viz. ease of forming and strength. However, in recent years a third requirement of improvement in fuel consumption is also bestowed upon automobiles in view of global environment concerns. Thus, now automotive parts must be made of material having high formability in order that to fit in the criteria of ease of fit in the intricate automobile assembly and at same time have to improve strength for vehicle crashworthiness and durability while reducing the weight of vehicle to improve fuel efficiency.

Therefore, intense Research and development endeavors are undertaken to reduce the amount of material utilized in car by increasing the strength of material. Conversely, an increase in strength of steel sheets decreases formability, and thus development of materials having both high strength and high formability is necessitated.

Earlier research and developments in the field of high strength and high formability steel sheets have resulted in several methods for producing high strength and high formability steel sheets, some of which are enumerated herein for conclusive appreciation of the present invention:

EP2971209 is patent that relates to a high strength hot dip galvanised complex phase steel strip having improved formability to be used in the automotive industry having an mandatory elemental composition C: 0.13-0.19%, Mn: 1.70-2.50% Si: 0-0.15%, Al: 0.40-1.00%, Cr: 0.05-0.25%, Nb: 0.01-0.05%, P: 0-0.10%, Ca: 0-0.004%, S: 0-0.05%, N: 0-0.007% the balance being Fe and inevitable impurities, wherein 0.40%<Al+Si<1.05% and Mn+Cr>1.90%, and having a complex phase microstructure, in volume percent, comprising 8-12% retained austenite, 20-50% bainite, less than 10% martensite, the remainder being ferrite but the granted patent is unable to reach the tensile strength beyond 900 MPa.

SUMMARY OF THE INVENTION

The known prior art related to the manufacture of high strength and high formability steel sheets is inflicted by one or the other problems lacuna: hence there lies a need for a cold rolled steel sheet having high strength and high formability and a method of manufacturing the same.

It is an object of the present invention to provide cold-rolled steel sheets that simultaneously have:

- an ultimate tensile strength greater than or equal to 950 MPa and preferably above 980 MPa,
- a total elongation greater than or equal to 14.0%
- a yield strength of 600 MPa or more and preferably 630 MPa more.

In a preferred embodiment, the steel sheet according to the invention may have a YS/TS ratio of greater than 0.55.

Preferably, such steel can also have a good suitability for forming, in particular for rolling with good weldability and coat ability.

Another object of the present invention is also to make available a method for the manufacturing of these sheets that is compatible with conventional industrial applications while being robust towards manufacturing parameters shifts.

Other characteristics and advantages of the invention will become apparent from the following detailed description of the invention.

DETAILED DESCRIPTION

Carbon is present in the steel between 0.1% and 0.25%. Carbon is an element necessary for increasing the strength of a steel sheet by producing a low-temperature transformation phase such as martensite. Further carbon also plays a pivotal role in austenite stabilization. A content less than 0.1% would not allow stabilizing austenite nor securing at least 20% of martensite, thereby decreasing strength as well as ductility. On the other hand, at a carbon content exceeding 0.25%, a weld zone and a heat-affected zone are significantly hardened, and thus the mechanical properties of the weld zone are impaired. The preferred limit for Carbon is between 0.12 and 0.22% and more preferably is between 0.15 and 0.20%.

Manganese content of the steel of the present invention is between 2.15% and 3.0%. Manganese is an element that imparts strength as well as stabilizes austenite to obtain residual austenite. An amount of at least 2.15% by weight of manganese has been found to provide the strength and hardenability of the steel sheet as well as to stabilize austenite. Thus, a higher percentage of Manganese such as 2.2 to 2.9% is preferred. But when manganese is more than 3.0%, this produces adverse effects such as slowing down the transformation of austenite to bainite during the isothermal holding for bainite transformation, leading to a reduction of ductility. Moreover, a manganese content above 3.0% would also reduce the weldability of the present steel. Hence the preferred limit for the steel of the present invention is between 2.2% and 2.9% and more preferably between 2.3% and 2.6%.

Silicon is an essential element for the steel of the present invention. Silicon is present between 0.1% and 0.8%. Silicon is added to the steel of the present invention to impart strength by solid solution strengthening. Silicon plays a part in the formation of the microstructure by preventing the precipitation of carbides and by promoting the formation of martensite. But whenever the silicon content is more than 0.8%, surface properties and weldability of steel are deteriorated, therefore the Silicon content is preferred between 0.15% and 0.7% and more preferably 0.2% and 0.6%.

Aluminum content of the present invention is between 0.1% and 0.9%. Aluminum is added to de-oxidize the steel of the present invention. Aluminum is an alphageneous element and also promotes the stabilization of Austenite by retarding the formation of carbides. This can increase the formability and ductility of steel. In order to obtain such an effect, Aluminum content is required at 0.1% or more. However, when the Aluminum content exceeds 0.9%, the Ac3 point increases beyond an acceptable value, and the austenite single phase is very difficult to achieve industrially hence hot rolling in complete austenite region cannot be performed. Therefore, Aluminum content must not be more than 0.9%. The preferable limit for the presence of Aluminum is between 0.2% and 0.8% and more preferably 0.3% and 0.8%.

Chromium content of the steel of the present invention is between 0.05% and 0.5%. Chromium is an essential element that provide strength and hardening to the steel, but when used above 0.5% impairs the surface finish of the steel. The preferred limit for Chromium is between 0.1% and 0.4% and more preferably 0.1% and 0.3%.

Phosphorus content of the steel of the present invention is limited to 0.09%. Phosphorus is an element which hardens in solid solution and also interferes with formation of carbides. Therefore, a small amount of phosphorus, of at least 0.002% can be advantageous, but phosphorus has adverse effects also, such as a reduction of the spot weldability and the hot ductility, particularly due to its tendency to segregation at the grain boundaries or co-segregation with manganese. For these reasons, its content is preferably limited to a maximum of 0.05%.

Sulfur is not an essential element but may be contained as an impurity in steel up to 0.09%. The sulfur content is preferred as low as possible, but between 0.001% and 0.03% is preferred from the viewpoint of manufacturing cost. Further if higher sulfur is present in steel it combines to form sulfide especially with Mn and Ti and reduces their beneficial impact on the present invention.

Nitrogen is limited to 0.09% in order to avoid ageing of material, nitrogen forms the nitrides which impart strength to the steel of the present invention by precipitation strengthening with Vanadium and Niobium but whenever the presence of nitrogen is more than 0.09% it can form high amount of Aluminum Nitrides which are detrimental for the present invention hence the preferable upper limit for nitrogen is 0.01%.

Carbon and manganese are cumulatively present in the steel between 2.4% and 3%. Carbon and Manganese both stabilizes the Austenite in the steel of the present invention as well as provide strength to steel of the present invention. A minimum of 2.4% of cumulative amount to have residual austenite of 8% to ensure the 14.0% elongation while reaching the tensile strength of 950 MPa for the steel of the present invention but whenever the cumulative amount of carbon and manganese is more than 3% the strengthening effect predominates while the elongation and tensile strength balance is no more attractive. The preferred limit for the cumulative presence of Carbon and manganese is between 2.5% and 2.9% and more preferably between 2.5% and 2.8%.

Niobium is an optional element that can be added to the steel up to 0.1%, preferably between 0.0010 and 0.1%. It is suitable for forming carbonitrides to impart strength to the steel according to the invention by precipitation hardening. Because niobium delays the recrystallization during the heating, the microstructure formed at the end of the holding temperature and as a consequence after the complete annealing is finer, this leads to the hardening of the product. But, when the niobium content is above 0.1% the amount of carbo-nitrides is not favorable for the present invention as large amount of carbo-nitrides tend to reduce the ductility of the steel.

Titanium is an optional element which may be added to the steel of the present invention up to 0.1%, preferably between 0.001% and 0.1%. As niobium, it is involved in carbo-nitrides so plays a role in hardening. But it is also involved to form TiN appearing during solidification of the cast product. The amount of Ti is so limited to 0.1% to avoid coarse TiN detrimental for hole expansion. In case the titanium content is below 0.001% it does not impart any effect on the steel of the present invention.

Vanadium is an optional element which may be added to the steel of the present invention up to 0.1%, preferably between 0.001% and 0.01%. As niobium, it is involved in carbo-nitrides so plays a role in hardening. But it is also involved to form VN appearing during solidification of the cast product. The amount of V is so limited to 0.1% to avoid coarse VN detrimental for hole expansion. In case the vanadium content is below 0.001% it does not impart any effect on the steel the of present invention.

Molybdenum is an optional element that constitutes between 0% and 1% of the Steel of the present invention; Molybdenum increases the hardenability of the steel of the present invention and influences the transformation of austenite to Ferrite and Bainite during cooling after annealing. However, the addition of Molybdenum excessively increases the cost of the addition of alloy elements, so that for economic reasons its content is limited to 1%.

Nickel may be added as an optional element in an amount of 0% to 1% to increase the strength of the steel and to improve its toughness. A minimum of 0.01% is required to produce such effects. However, when its content is above 1%, Nickel causes ductility deterioration.

Calcium is an optional element which may be added to the steel of the present invention up to 0.005%, preferably between 0.001% and 0.005%. Calcium is added to the steel of the present invention as an optional element especially during the inclusion treatment. Calcium contributes towards the refining of the steel by arresting the detrimental sulphur content in globularizing it.

Other elements such as cerium, boron, magnesium or zirconium can be added individually or in combination in the following proportions: Ce≤0.1%, B≤0.01%, Mg≤0.05% and Zr≤0.05%. Up to the maximum content levels indicated, these elements make it possible to refine the grain during solidification.

The remainder of the composition of the steel consists of iron and inevitable impurities resulting from processing.

The microstructure of the steel sheet according to the invention comprises 20% to 70% of martensite, 5% to 60% Inter-critical ferrite, 5% to 30% transformed ferrite, 8% to 20% of residual austenite, 1% to 20% of bainite and cumulative amount of inter-critical ferrite and transformed ferrite between 15% and 65% in area fractions. Martensite constitutes between 20% and 70% of the microstructure by area fraction. The martensite of the present invention can comprise both fresh and tempered martensite as well as in the form of MA islands. However, tempered martensite is an optional microconstituent which is preferably limited in the steel at an amount of between 0% and 10%, preferably between 0 and 5%. Tempered martensite may form during cooling after annealing. Fresh martensite forms during the cooling after overaging holding. The martensite of the present invention imparts ductility and strength to such steel. Preferably, the content of martensite is between 20% and 60% and more preferably between 24% and 56%.

Inter-critical ferrite constitutes between 5% and 60% of microstructure by area fraction of the steel of the present invention. This inter-critical ferrite imparts the steel the of present invention with total elongation of at least 14.0%. The intercritical ferrite results from the annealing at a temperature below Ac3. The intercritical ferrite is different from the ferrite that could be created after the annealing, named hereinafter "transformed ferrite", that will be described below. In particular, contrarily to the transformed ferrite, the intercritical ferrite is polygonal. Besides, the transformed ferrite is enriched in carbon and manganese, i.e. has carbon and manganese contents which are higher than the carbon and manganese contents of the intercritical ferrite. The intercritical ferrite and the transformed ferrite can therefore be differentiated by observing a micrograph with a FEG-TEM microscope using secondary electrons, after etching with metabisulfite. On such a micrograph, the intercritical ferrite appears in medium grey, whereas the transformed ferrite appears in dark grey, owing to its higher carbon and manganese contents. The preferred limit for the presence of inter-critical ferrite in the steel of the present invention is between 5% and 50% and more preferably between 10% and 50%.

Transformed Ferrite constitutes from 5% to 30% of microstructure by area fraction for the Steel of the present invention. Transformed Ferrite of present invention constitutes of Ferrite formed after annealing and bainitic ferrite formed during soaking for coating the steel. Transformed Ferrite imparts high strength as well as elongation to the steel of the present invention. To ensure an elongation of 14.0% and preferably 15% or more it is necessary to have 5% of transformed ferrite. Transformed Ferrite of the present invention is formed during cooling done after annealing and during soaking for coating the steel. Transformed Ferrite of the present steel is rich in carbon and Manganese as compared to the inter-critical ferrite. But whenever the transformed ferrite content is present above 30% in steel of the present invention it is not possible to have both tensile strength and the total elongation at same time. The preferred limit for presence of ferrite for the present invention is between 6% and 25% and more preferably 7% and 20%.

Residual Austenite constitutes from 8% to 20% by area fraction of the Steel. Residual Austenite of the Steel according to the invention imparts an enhanced ductility due to the TRIP effect. Residual Austenite of the present invention may also be present in MA island form. The preferable limit of for the presence of Austenite is between 8% and 18% and more preferably between 8% and 15%. In a preferred embodiment, residual Austenite contains carbon in an amount higher than 0.8 wt % and lower than 1.1 wt % more preferably between 0.9 wt % and 1.1 wt % and even more preferably between 0.95 wt % and 1.05 wt %.

Bainite constitutes from 1% to 20% of microstructure by area fraction for the Steel of the present invention. In the present invention, Bainite cumulatively consists of Lath Bainite and Granular Bainite, To ensure tensile strength of 950 MPa a or more it is necessary to have at least 1% of Bainite. Bainite is formed during over-aging holding.

The cumulated amount of transformed ferrite and inter-critical ferrite must be between 15% and 65%, this cumulative amount of transformed ferrite and inter-critical ferrite ensures that the steel of the present invention always have a total elongation of at least 14.0% as well as tensile strength of 950 MPa simultaneously.

The steel sheet according to the invention may be obtained by any appropriate method. It is however preferred to use the process according to the preferred embodiments of the invention, which comprises the following successive steps:

Such process includes providing a semi-finished product of steel with a chemical composition according to the invention. The semi-finished product can be cast either into ingots or continuously in form of thin slabs or thin strips, i.e. with a thickness ranging from approximately 220 mm for slabs up to several tens of millimeters for thin strip, for example.

For the purpose of simplification of the present invention, a slab will be considered as a semi-finished product. A slab having the above-described chemical composition is manufactured by continuous casting wherein the slab preferably underwent a direct soft reduction during casting to ensure the elimination of central segregation and porosity reduction. The slab provided by continuous casting process can be used directly at a high temperature after the continuous casting or may be first cooled to room temperature and then reheated for hot rolling.

The temperature of the slab which is subjected to hot rolling is at least 1000° C., preferably at least 1050° C., preferably above 1100° C. and must be below 1250° C. In case the temperature of the slab is lower than 1000° C., excessive load is imposed on a rolling mill, and further, the temperature of the steel may decrease to a ferrite transformation temperature during finishing rolling, whereby the steel will be rolled in a state in which transformed ferrite contained in the structure. Further, the temperature must not be above 1250° C. as there would be a risk of formation of rough ferrite grains resulting in coarse ferrite grain which decreases the capacity of these grains to re-crystallize during hot rolling. The larger the initial ferrite grain size, the less easily it re-crystallizes, which means that reheat temperatures above 1250° C. must be avoided because they are industrially expensive and unfavorable in terms of the recrystallization of ferrite.

The temperature of the slab is preferably sufficiently high so that hot rolling can be completed entirely in the austenitic range and performing hot rolling between Ac3 and Ac3+200° C., the finishing hot rolling temperature remaining above Ac3 and preferably above Ac3+50° C. It is necessary that the final rolling be performed above Ac3, because below this temperature the steel sheet exhibits a significant drop in rollability. A final rolling temperature should preferably be above Ac3+50° C. to have a structure that is favorable to recrystallization and rolling.

The sheet obtained in this manner is then cooled at a cooling rate of at least 30° C./s to the coiling temperature which is below 600° C. Preferably, the cooling rate will be less than or equal to 65° C./s and above 35° C./s. The coiling temperature is preferably above 350° C. to avoid the transformation of austenite into ferrite and pearlite and to contribute in forming an homogenous bainite and martensite microstructure.

The coiled hot rolled steel sheet may be cooled down to room temperature before subjecting it to an optional hot band annealing or may be send to an optional hot band annealing directly.

Hot rolled steel sheet may be subjected to an optional pickling to remove the scale formed during the hot rolling, if needed. The hot rolled sheet is then subjected to an optional hot band annealing at a temperature between 400° C. and 750° C. preferably during 1 to 96 hours.

Thereafter, pickling of this hot rolled steel sheet may be performed if necessary to remove the scale.

The hot rolled steel sheets are then cold rolled with a thickness reduction between 35 to 90%. The cold rolled steel sheet is then subjected to annealing to impart the steel of the present invention with targeted microstructure and mechanical properties.

The said cold rolled steel sheet is then annealed in two steps heating wherein the first step starts from heating the steel sheet from room temperature to a temperature T1 between 600° C. and 750° C., with a heating rate HR1 of at least 2° C./s the preferred range for HR1 is between 2° C./s and 40° C./s and more preferably between 3° C./s and 25° C./s, thereafter the second step starts from heating further the steel sheet from T1 to a soaking temperature T2 between Ac1 and Ac3, with a heating rate HR2 of 15° C./s or less, HR2 being lower than HR1, then perform annealing at T2 during 10 to 500 seconds. In a preferred embodiment, the heating rate for the second step is less than 5° C./s and more preferably less than 3° C./s. The preferred temperature T2 for soaking is between Ac1+30° C. and Ac3 and more preferably between Ac1+30° C. and Ac3-20° C.

The second heating step ensures that the steel of the present invention has enough time at high temperature so that all the precipitates, such as cementite, formed in previous processing steps dissolve completely. This results in the austenite of the present invention having an homogenous carbon content between 0.8 wt % and 1.1 wt %. and in the inter-critical ferrite being from 5 to 60% in area fraction Then the cold rolled steel sheet is annealed at soaking temperature T2 between Ac1 and Ac3 wherein In a preferred embodiment, the temperature of soaking is selected so as to ensure that the microstructure of the steel sheet at the end of the soaking contains at least 50% of Austenite and more preferably at least 60% of austenite.

Then the cold rolled steel is cooled from T2 to an overaging holding temperature Tover between Ms−50° C. and 500° C., preferably between Ms−40° C. and 490° C., at an average cooling rate of at least 5° C./s and preferably at least 10° C./s and more preferably 15° C./s, wherein the cooling step may include an optional slow cooling sub-step between T2 and a temperature Tsc between 600° C. and 750° C., with a cooling rate of 2° C./s or less and preferably of 1° C./s or less.

The cold rolled steel sheet is then held at Tover during 5 to 500 seconds.

In a first embodiment, the cold rolled steel sheet is then cooled to room temperature to obtain a heat treated cold rolled steel sheet according to the invention. In another embodiment, the cold rolled steel sheet may undergo a post batch annealing at a temperature between 150° C. and 300° C. during 30 minutes to 120 hours. In another embodiment, the cold rolled steel sheet may be optionally brought to the temperature of the coating bath to facilitate hot dip coating of the cold rolled steel sheet and to perform optional coating, depending on the nature of the coating In the case of zinc coating, such temperature of the steel may be kept between 42° and 460° C.

The cold rolled steel sheet can also be coated by any of the known industrial processes such as Electro-galvanization, JVD, PVD, etc., which may not require bringing it to the above mentioned temperature range before coating.

Examples

The following tests and examples presented herein are non-restricting in nature and must be considered for purposes of illustration only and will display the advantageous features of the present invention and expound the significance of the parameters chosen by inventors after extensive experiments and further establish the properties that can be achieved by the steel according to the invention.

Samples of the steel sheets according to the invention and to some comparative grades were prepared with the compositions gathered in table 1 and the processing parameters gathered in table 2. The corresponding microstructures of those steel sheets were gathered in table 3 and the properties in table 4.

Table 1 depicts the steels with the compositions expressed in percentages by weight.

TABLE 1 composition of the trials

| Trials | C | Mn | Si | Al | Cr | P | S | N | Nb | C + Mn | Ac1 (° C.) | Ac3 (° C.) | Ms (° C.) | Bs (° C.) |
|---|---|---|---|---|---|---|---|---|---|---|---|---|---|---|
| A | 0.185 | 2.51 | 0.41 | 0.65 | 0.104 | 0.002 | 0.0010 | 0.001 | 0 | 2.70 | 711 | 895 | 362 | 548 |
| B | 0.186 | 2.33 | 0.39 | 068 | 0.196 | 0.002 | 0.0010 | 0.001 | 0 | 2.52 | 713 | 896 | 367 | 557 |
| C | 0.186 | 2.43 | 0.20 | 0.77 | 0.202 | 0.002 | 0.0010 | 0.002 | 0.002 | 2.62 | 706 | 889 | 366 | 553 |
| D | 0.190 | 2.09 | 0.39 | 0.70 | 0.109 | 0.002 | 0.0010 | 0.002 | 0 | 2.28 | 714 | 901 | 374 | 583 |
| E | 0.191 | 2.28 | 0.01 | 0.98 | 0.120 | 0.002 | 0.0010 | 0.002 | 0 | 2.47 | 701 | 898 | 372 | 574 |
| F | 0.175 | 2.23 | 0.92 | 0.03 | 0.200 | 0.010 | 0.0010 | 0.002 | 0 | 2.41 | 730 | 885 | 369 | 557 |

Table 2 gathers the annealing process parameters implemented on steels of Table 1.

Table 1 also shows Bainite transformation Bs and Martensite transformation Ms temperatures of inventive steel and reference steel. The calculation of Bs is done by using Van Bohemen formula published in Materials Science and Technology (2012) vol 28, no 4, pp 487-495, which is as follows:

$$Bs=839-(86*[Mn]+23*[Si]+67*[Cr]+33*[Ni]+75*[Mo])-270*(1-EXP(-1,33*[C]))$$

The calculation of Ms is done using Barbier formula:

$$Ms=545-601.2*(1-Exp(1-0.868*C\ \%))-34.4*Mn\ \%-13.7Si\ \%-9.2Cr\ \%-17.3Ni\ \%-15.4Mo\ \%+10.8V\ \%+4.7Co\ \%-1.4Al\ \%-16.3Cu\ \%-361Nb\ \%-2.44Ti\ \%-3448B\ \%$$

It also shows Ac1 and Ac3 values that are calculated by using the following formula:

$$Ac1=723-10,7[Mn]-16,9[Ni]+29,1[Si]+16,9[Cr]+6,38[W]+290[As]$$

$$Ac3=955-350[C]-25[Mn]+51[Si]+106[Nb]+100[Ti]+68[Al]-11[Cr]-33[Ni]-16[Cu]+67[Mo]$$

wherein the elements contents are expressed in weight percent.

All the examples and counter examples are reheated to a temperature of 1200° C. and then hot rolled wherein the hot rolled finishing temperature is 920° C. thereafter the hot rolled steel strip is coiled at 550° C. and cold rolled reduction for all examples and counter examples is 60%.

TABLE 2 process parameters of the trials

| Trials | Samples | HR1 (° C./s) | T1 (° C.) | HR2 (° C./s) | T2 (° C.) | Soaking time (s) | Cooling rate (° C./s) | Tover (° C.) | Overaging time (s) |
|---|---|---|---|---|---|---|---|---|---|
| I1 | A | 18.9 | 720 | 0.8 | 840 | 385 | 40 | 320 | 145 |
| I2 | B | 4.0 | 720 | 1.2 | 840 | 90 | 21 | 420 | 40 |
| I3 | A | 4.0 | 720 | 1.2 | 840 | 90 | 18.3 | 460 | 40 |
| I4 | C | 3.9 | 720 | 1.2 | 820 | 90 | 20 | 420 | 40 |
| R1 | D | 4.0 | 720 | 1.2 | 840 | 90 | 18.3 | 460 | 40 |
| R2 | E | 4.0 | 720 | 1.2 | 840 | 90 | 18.3 | 460 | 40 |
| R3 | F | 4.0 | 720 | 1.2 | 840 | 90 | 21 | 420 | 40 |

underlined values: not according to the invention.

Table 3 gathers the results of tests conducted in accordance of standards on different microscopes such as Scanning Electron Microscope for determining microstructural composition of both the inventive steel and reference trials.

TABLE 3 microstructures of the trials

| | Martensite (%) | Intercritical Ferrite (%) | Transformed Ferrite (%) | Residual Austenite (%) | Bainite (%) | Ferrite (%) |
|---|---|---|---|---|---|---|
| I1 | 55.2 | 10.9 | 19.4 | 8.2 | 6.3 | 30.3 |
| I2 | 33.6 | 30.2 | 11.5 | 14.0 | 10.7 | 41.7 |
| I3 | 25.5 | 46.0 | 8.8 | 14.5 | 5.2 | 54.8 |
| I4 | 27.6 | 36.9 | 19.1 | 15.4 | 1.0 | 56.0 |
| R1 | 12.4 | 44.1 | 23.2 | 16.3 | 4.0 | 67.3 |
| R2 | 9.9 | 38.9 | 16.5 | 16.0 | 18.7 | 55.4 |
| R3 | 17.8 | 0 | 6.1 | 11.0 | 65.1 | 6.1 |

underlined values: not according to the invention.

Table 4 gathers the mechanical properties of both the inventive steel and reference steel. The tensile strength yield strength and total elongation test are conducted in accordance with ISO 6892-1 standard.

TABLE 4 mechanical properties of the trials

| Trials | Tensile strength (MPa) | YS (MPa) | Total Elongation (%) |
|---|---|---|---|
| I1 | 986 | 736 | 16.5 |
| I2 | 1003 | 631 | 17.3 |
| I3 | 1016 | 746 | 14.0 |
| I4 | 1121 | 650 | 14.0 |
| R1 | 861 | 553 | 20.4 |
| R2 | 802 | 542 | 19.4 |
| R3 | 1047 | 766 | 13.6 |

The examples show that the steel sheets according to the invention are the only one to show all the targeted properties thanks to their specific composition and microstructures.

What is claimed is:

1. A heat treated cold rolled steel sheet having a composition comprising the following elements, expressed in percentage by weight:

0.1%≤Carbon≤0.25%
2.15%≤Manganese≤3.0%
0.1%≤Silicon≤0.8%
0.1%≤Aluminum≤0.9%
0.05%≤Chromium≤0.5%
0%≤Phosphorus≤0.09%
0%≤Sulfur≤0.09%
0%≤Nitrogen≤0.09%
2.4%≤C+Mn≤3% and optionally one or more of the following elements

0%≤Niobium≤0.1%
0%≤Titanium≤0.1%
0%≤Vanadium≤0.1%
0%≤Molybdenum≤1%
0%≤Nickel≤1%
0%≤Calcium≤0.005%
0%≤Boron≤0.01%
0%≤Cerium≤0.1%
0%≤Magnesium≤0.05%
0%≤Zirconium≤0.05% a remainder being composed of iron and unavoidable impurities caused by processing, a microstructure of the steel sheet comprising in area fraction, 20% to 70% Martensite, 5 to 60% of Inter-critical Ferrite, 5 to 30% of Transformed Ferrite, 8% to 20% of Residual Austenite wherein the carbon of the Residual Austenite is between 0.8 wt % and 1.1 wt %, and 1 to 20% Bainite, wherein a cumulated amount of Inter-critical and Transformed Ferrite is between 15% and 65%.

2. The heat treated cold rolled steel sheet as recited in claim 1 wherein the composition includes 0.15% to 0.7% of Silicon.

3. The heat treated cold rolled steel sheet as recited in claim 1 wherein the composition includes 0.12% to 0.22% of Carbon.

4. The heat treated cold rolled steel sheet as recited in claim 1 wherein the composition includes 0.2% to 0.8% of Aluminum.

5. The heat treated cold rolled steel sheet as recited in claim 1 wherein the composition includes 2.2% to 2.9% of Manganese.

6. The heat treated cold rolled steel sheet as recited in claim 1 wherein the cumulated amounts of Carbon and Manganese is between 2.5% and 2.9%.

7. The heat treated cold rolled steel sheet as recited in claim 1 wherein the carbon content of residual austenite is between 0.9% and 1.1%.

8. The heat treated cold rolled steel sheet as recited in claim 1 wherein the inter-critical ferrite is between 5% and 50%.

9. The heat treated cold rolled steel sheet as recited in claim 1 wherein the transformed ferrite is between 6% and 25%.

10. The heat treated cold rolled steel sheet as recited in claim 1 wherein the martensite is between 20% and 60%.

11. The heat treated cold rolled steel sheet as recited in claim 1 wherein said steel sheet has an ultimate tensile strength of 950 MPa or more, and a total elongation of 14.0% or more.

12. The heat treated cold rolled steel sheet as recited in claim 1 wherein said steel sheet has a yield strength of 600 MPa or more.

13. A method of production of a cold rolled steel sheet comprising the following successive steps:

providing a semi-finished product with a steel composition with the following elements expressed in percentage by weight:

0.1%≤Carbon≤0.25%
2.15%≤Manganese≤3.0%
0.1%≤Silicon≤0.8%
0.1%≤Aluminum≤0.9%
0.05%≤Chromium≤0.5%
0%≤Phosphorus≤0.09%
0%≤Sulfur≤0.09%
0%≤Nitrogen≤0.09%
2.4%≤C+Mn≤3% and optionally one or more of the following elements

0%≤Niobium≤0.1%
0%≤Titanium≤0.1%
0%≤Vanadium≤0.1%
0%≤Molybdenum≤1%
0%≤Boron≤0.01%
0%≤Cerium≤0.1%
0%≤Magnesium≤0.05%
0%≤Zirconium≤0.05% a remainder being composed of iron and unavoidable impurities caused by processing, reheating said semi-finished product to a temperature between 1000° C. and 1250° C.;

rolling the semi-finished product in the temperature range between Ac3 and Ac3+200° C., wherein a hot rolling finishing temperature is above Ac3 to obtain a hot rolled steel;

cooling the hot rolled steel at a cooling rate of at least 30° C./s to a coiling temperature less than 600° C.; and coiling the hot rolled steel;

cooling the hot rolled steel to room temperature;

optionally performing scale removal process on said hot rolled steel sheet;

optionally annealing is performed on hot rolled steel sheet between 400° C. and 750° C.;

optionally performing scale removal process on the hot rolled steel sheet;

cold rolling the hot rolled steel sheet with a reduction rate between 35 and 90% to obtain a cold rolled steel sheet;

annealing the cold rolled steel sheet in two steps heating wherein:

the first step consists in heating the steel sheet from room temperature to a temperature T1 between 600° C. and 750° C., with a heating rate HR1 of at least 2° C./s, the second step starts from heating further the steel sheet from T1 to a soaking temperature T2 between Ac1 and Ac3, with a heating rate HR2 of 15° C./s or less, HR2 being lower than HR1, then perform annealing at T2 for 10 to 500 seconds, then cooling the cold rolled steel sheet from T2 to an overaging temperature Tover between Ms−50° C. and 500° C. at an average cooling rate of at least 5° C./s, the cooling optionally including a slow cooling sub-step between T2 and a temperature Tsc between 600° C. and 750° C. with a slow cooling rate of 2° C./s or less;

then overaging the cold rolled steel sheet at a temperature Tover for 5 to 500 seconds and brought to a temperature range between 420° C. and 460° C. to facilitate optional coating, then optionally performing a post batch annealing between temperature range 150° C. and 300° C. during 30 minutes to 120 hours;

thereafter cooling the cold rolled steel sheet to room temperature to obtain the heat treated cold rolled steel sheet as recited in claim 1.

14. The method as recited in claim 13 wherein the coiling temperature is between 350° C. and 600° C.

15. The method as recited in claim 13 wherein the finishing hot rolling temperature is more than Ac3+50° C.

16. The method as recited in claim 13 wherein the soaking temperature T2 is selected so as to ensure the presence of at least 50% of austenite at the end of the soaking.

17. A method for the manufacture of a structural or safety part of a vehicle comprising performing the method as recited in claim 13.

18. A method for the manufacture of a structural or safety part of a vehicle comprising employing the steel sheet as recited in claim 1.

19. A vehicle comprising the structural or safety part obtained by performing the method as recited in claim 17.

20. A vehicle comprising the structural or safety part obtained by performing the method as recited in claim 18.

* * * * *